US009788666B2

(12) United States Patent
Wood et al.

(10) Patent No.: US 9,788,666 B2
(45) Date of Patent: Oct. 17, 2017

(54) REFRIGERATED DISPLAY APPLIANCES

(71) Applicant: Applied Design and Engineering Ltd, Lowestoft, Suffolk (GB)

(72) Inventors: Ian Wood, Lowestoft (GB); Edward Hammond, Lowestoft (GB)

(73) Assignee: Applied Design and Engineering Ltd., Lowestoft, Suffolk (GB)

( * ) Notice: Subject to any disclaimer, the term of this patent is extended or adjusted under 35 U.S.C. 154(b) by 0 days.

(21) Appl. No.: 14/889,898

(22) PCT Filed: May 12, 2014

(86) PCT No.: PCT/GB2014/051451
§ 371 (c)(1),
(2) Date: Nov. 9, 2015

(87) PCT Pub. No.: WO2014/181135
PCT Pub. Date: Nov. 13, 2014

(65) Prior Publication Data

US 2016/0113418 A1 Apr. 28, 2016

(30) Foreign Application Priority Data

May 10, 2013 (GB) ..... 1308437.1

(51) Int. Cl.
*A47B 37/00* (2006.01)
*A47F 3/04* (2006.01)
*G09F 3/20* (2006.01)

(52) U.S. Cl.
CPC ..... *A47F 3/0447* (2013.01); *G09F 3/204* (2013.01); *A47F 2003/046* (2013.01)

(58) Field of Classification Search
CPC .... A47F 3/0447; A47F 3/0482; A47F 3/0491; A47F 2003/046; G09F 3/204
See application file for complete search history.

(56) References Cited

U.S. PATENT DOCUMENTS 2,962,875 A * 12/1960 Barroero ..... A47F 3/0452 62/256
3,139,738 A * 7/1964 Jarvis ..... A47F 3/0452 62/256

(Continued)

FOREIGN PATENT DOCUMENTS

EP 0589783 A1 3/1994
EP 2380465 A1 10/2011

(Continued)

OTHER PUBLICATIONS

John de Bruijn; International Search Report and Written Opinion of the International Searching Authority dated Aug. 28, 2014, for PCT/GB2014/051453; The International Bureau of WIPO.

(Continued)

*Primary Examiner* — Hanh V Tran
(74) *Attorney, Agent, or Firm* — Stevens & Showalter LLP

(57) ABSTRACT

A ducted shelf for an open-fronted display unit employing air curtains. The shelf has a supply duct at a lower level communicating with a downwardly-facing forward discharge outlet and a return duct at an upper level communicating with an upwardly-facing forward return inlet. In front-to-back section through the shelf, a forward supply duct extension in front of the supply duct narrows forwardly above the discharge outlet and a forward return duct extension in front of the return duct reaches downwardly to the lower level of the shelf to lie forwardly of the supply duct. This beneficially reduces the thickness of the front of the shelf.

34 Claims, 8 Drawing Sheets

(56) References Cited

U.S. PATENT DOCUMENTS

| | | | | | |
|---|---|---|---|---|---|
| 3,168,818 | A * | 2/1965 | Weber | A47F 3/0452 | 62/256 |
| 3,218,822 | A * | 11/1965 | Bently | A47F 3/0447 | 165/133 |
| 3,289,432 | A * | 12/1966 | Brennan | A47F 3/0447 | 62/256 |
| 3,403,525 | A | 10/1968 | Beckwith et al. | | |
| 4,314,458 | A * | 2/1982 | Hade | A47F 3/0408 | 62/256 |
| 4,671,074 | A | 6/1987 | Gostelow et al. | | |
| 4,938,034 | A * | 7/1990 | Rosanio | A47F 3/0447 | 62/256 |
| 5,357,767 | A * | 10/1994 | Roberts | A47F 3/0447 | 454/193 |
| 5,722,252 | A | 3/1998 | Kang et al. | | |
| 6,519,962 | B1 | 2/2003 | Schuetter | | |
| 6,742,344 | B2 * | 6/2004 | Vormedal | A47F 3/0447 | 454/193 |
| 6,971,247 | B2 | 12/2005 | Yamazaki et al. | | |
| 7,137,438 | B2 | 11/2006 | Nomura et al. | | |
| 9,084,496 | B1 | 7/2015 | Neelagantan et al. | | |
| 9,265,359 | B2 | 2/2016 | Wood et al. | | |
| 2004/0177634 | A1 | 9/2004 | Yamazaki et al. | | |
| 2005/0061758 | A1 * | 3/2005 | Nomura | A47F 3/0443 | 211/85.4 |
| 2006/0199495 | A1 | 9/2006 | Yamaguchi | | |
| 2008/0236182 | A1 | 10/2008 | Hahn | | |
| 2010/0024446 | A1 | 2/2010 | Rohrer et al. | | |
| 2013/0019621 | A1 * | 1/2013 | Wood | A47F 3/0447 | 62/126 |
| 2016/0113418 | A1 | 4/2016 | Wood et al. | | |
| 2016/0113419 | A1 | 4/2016 | Wood et al. | | |

FOREIGN PATENT DOCUMENTS

| | | | |
|---|---|---|---|
| JP | S55165468 | A | 12/1980 |
| JP | 2000028255 | A | 1/2000 |
| JP | 2002318055 | A | 10/2002 |
| JP | 2004261502 | A | 9/2004 |
| WO | 2008052589 | A1 | 5/2008 |
| WO | 2011121284 | A2 | 10/2011 |
| WO | 2011121285 | A1 | 10/2011 |
| WO | 2014181135 | A3 | 11/2014 |
| WO | 2014181136 | A2 | 11/2014 |
| WO | 2014184531 | A1 | 11/2014 |
| ZA | 9806184 | A | 1/1999 |

OTHER PUBLICATIONS

Martinez Valero; International Search Report and Written Opinion of the International Searching Authority dated Jan. 27, 2015, for PCT/GB2014/051452; The International Bureau of WIPO.

Martinez Valero; International Search Report and Written Opinion of the International Searching Authority dated Jan. 22, 2015, for PCT/GB2014/051451; The International Bureau of WIPO.

Martinez Valero; International Preliminary Report on Patentability; dated Oct. 14, 2015; PCT/GB2014/051452; European Patent Office.

Martinez Valero; International Preliminary Report on Patentability; dated Jul. 23, 2015; PCT/GB2014/051451; European Patent Office.

Martinez Valero; International Preliminary Report on Patentability; dated Nov. 10, 2015; PCT/GB2014/051453; European Patent Office.

Ayres, Timothy Michael; Office Action; U.S. Appl. No. 14/890,244; dated Oct. 7, 2016; U.S. Patent and Trademark Office; Alexandria, VA.

Ayres, Timothy Michael; Final Office Action; U.S. Appl. No. 14/890,244; dated May 5, 2017; United States Patent and Trademark Office; Alexandria, VA.

* cited by examiner

REFRIGERATED DISPLAY APPLIANCES

This invention relates to refrigerated display appliances, exemplified in this specification by refrigerated multi-deck display cases or cabinets that are used in retail premises for cold-storage, display and retailing of chilled or frozen food and drink products.

The invention is not limited to retail food and drink cabinets. For example, the principles of the invention could be used to display other items that require cold storage, such as medicines or scientific items that may be prone to degradation. However, the principles of the invention are particularly advantageous for retail use.

It is well known to fit sliding or hinged glass doors to the front of a refrigerated display cabinet. In theory, but unfortunately not in practice, cold air is held behind the doors, preventing 'cold aisle syndrome' caused by cold air spilling from the open front of the cabinet into an aisle of such cabinets in retail premises. Aside from causing discomfort to shoppers, cold aisle syndrome wastes energy in keeping the cabinets cold and the retail premises warm.

Equipping a refrigerated display cabinet with doors has key disadvantages in a retail environment. Doors put a barrier between the shopper and the displayed items, which can reduce sales very significantly. Doors also create a barrier, and additional work, for staff tasked with restocking, cleaning and maintaining the cabinets, which adds significantly to retail overheads. Also, wider aisles may be needed to allow shoppers to open doors and to manage trolleys, which reduces the sales return per square meter of retail space. Additionally, heat may need to be applied to the doors to reduce fogging and misting following door opening, which increases energy consumption.

Despite incurring these significant disadvantages, doors do not work effectively to retain cold air for the simple reason that shoppers and staff in busy retail premises will open the doors frequently and sometimes for extended periods. Whenever the doors are open, cold dense air will spill out. The cold air lost from inside the cabinet will inevitably be replaced by ambient air. Consequently, in real conditions, the addition of doors to a cabinet does not significantly improve energy consumption, temperature control and ingress of ambient air.

Ingress of ambient air is undesirable during the operation of any refrigerated display appliance. The heat of incoming ambient air increases cooling duty and hence the energy consumption of the appliance. The moisture that the air carries causes condensation, which may also lead to icing. Condensation is unsightly, offputting and unpleasant for shoppers, may threaten reliable operation of the appliance and promotes microbial activity which, like all life, requires the presence of water. Also, the incoming ambient air will itself contain microbes, dust and other undesirable contaminants.

Specifically, when ambient air that is warm and moist enters the cabinet, it warms items stored within the cabinet and deposits moisture upon them as condensation. Warmer temperatures and higher moisture levels promote microbial activity, which reduces shelf-life, causes off-odours, promotes fungal growth and can cause food poisoning.

Shoppers like open-fronted multi-deck display cabinets without doors, as such cabinets provide unhindered access so that the items on display may be easily viewed, accessed and removed for closer inspection and purchase. Retailers also like such cabinets because they allow a wide range of products to be displayed clearly to and accessed easily by shoppers, with reduced maintenance overheads and better utilisation of retail floor space.

Typically, open-fronted refrigerated display cabinets employ a large downwardly-projected refrigerated air curtain extending between discharge and return air terminals from top to bottom over an access opening defined by the open front face of the cabinet. The purposes of the air curtain are twofold: to seal the access opening in an effort to prevent cold air spilling out from the product display space behind; and to remove heat from the product display space that is gained radiantly through the access opening and via infiltration of ambient air into the product display space.

A conventional air curtain requires high velocity to remain stable enough to seal the access opening of the cabinet. Unfortunately, however, high velocity increases the rate of entrainment of ambient air into the air curtain. Entrainment of ambient air drives infiltration of the ambient air into the product display space and contributes to spillage of cold air from the appliance. Also, a high-velocity stream of cold air is unpleasant for a shopper to reach through to access the product display space behind the air curtain.

Additional cooling air is typically supplied via a perforated back panel behind the product display space of the cabinet. That additional cooling air is bled from ducts supplying the air curtain to provide more cooling at each level within that space and to support the air curtain. This allows the air curtain velocity to be reduced and so reduces the entrainment rate of ambient air. However, even with measures such as back panel flow, conventional cabinets can suffer from ambient air entrainment rates as high as 80% in real conditions, causing excessive energy consumption and uncomfortably cold aisles.

Back panel flow has the disadvantage that the coldest air blows over the coldest items at the back of the shelves, which are subject to the lowest heat gain because they are furthest from the access opening. This undesirably increases the spread of temperature across items stored in the product display space. In this respect, it is vital that tight temperature control is maintained throughout the product display space of the cabinet. Regions of a cabinet warmer than the desired temperature will suffer from faster food degradation. Conversely, regions of a cabinet colder than the desired temperature may cycle above and below the freezing point, again promoting faster food degradation.

The levels within a refrigerated display cabinet are typically defined by one or more shelves, which may for example comprise solid or perforated panels or open baskets. Shelves partition the interior of the cabinet into a stack of two or more smaller product display spaces. Shelves and their associated product display spaces may also be partitioned into side-by-side columns. Each product display space is accessible through a respective open frontal access opening. Specifically, each shelf defines an upper access opening above the shelf and a lower access opening below the shelf affording access to refrigerated items in respective product display spaces in a cold-storage volume above and below the shelf.

Several proposals have been made to duct air through shelves of refrigerated display cabinet, to and/or from outlets and/or inlets forwardly-positioned on the shelf, to generate or to support air curtains. The aim is to help an air curtain to seal the open front of the cabinet more effectively, improving temperature control and lessening infiltration of ambient air.

In the Applicant's previous patent application published as WO 2011/121284, at least one forwardly-positioned discharge outlet communicates with a supply duct to project cold air as an air curtain across an access opening. At least one forwardly-positioned return inlet communicates with a return duct to receive air from the air curtain. Where the air curtain flows conventionally downwardly from top to bottom, the discharge outlet projects cold air as an air curtain across the lower access opening below the shelf and the return inlet receives air from another air curtain discharged above the shelf across the upper access opening above the shelf.

It is possible, albeit unconventional, for an air curtain to flow upwardly across an access opening from bottom to top. In that case, the discharge outlet projects cold air as an air curtain across the upper access opening and the return inlet receives air from another air curtain discharged below the shelf across the lower access opening. The present invention also encompasses this possibility.

WO 2011/121284 teaches a ducted shelf whose frontal structure comprises a downwardly-facing discharge opening or outlet and an upwardly-facing return opening or inlet. Each of those openings extends parallel to the shelf front and communicates with a respective duct stacked one above the other in the shelf or lying one beside the other in the shelf to supply air to the outlet and to receive air from the inlet.

The front of a ducted shelf comprises a downwardly-facing discharge opening and an upwardly-facing return opening, each communicating with a respective duct stacked one above the other in the shelf. Airflow management features including baffles, risers and flow straighteners are associated with these openings to ensure good air curtain performance.

Bulky, thick shelf fronts obscure visibility of, and access to, items stored and displayed within the unit. This hinders browsing by customers.

There is a need for shelves that present a slimmer front edge while still accommodating effective airflow management features, allowing space for product information and ticketing display and minimising condensation problems. Shallow shelf fronts improve visibility of, and access, to stored products, benefiting customer browsing.

It is against this background that the present invention has been devised.

From one aspect, the invention provides a ducted shelf for an open-fronted display unit employing air curtains, the shelf having: a front and a back defining a forward direction from back to front; a supply duct at a lower level of the shelf communicating with a downwardly-facing forward discharge outlet; and a return duct at an upper level of the shelf communicating with an upwardly-facing forward return inlet; wherein, in front-to-back section through the shelf, a forward supply duct extension in front of the supply duct narrows forwardly above the discharge outlet and a forward return duct extension in front of the return duct reaches downwardly to the lower level of the shelf to lie forwardly of the supply duct.

The return duct extension preferably widens forwardly below the return inlet and also may narrow rearwardly beyond a rearward edge of the return inlet. For example, the return duct extension suitably widens forwardly and narrows rearwardly by virtue of a downwardly- and forwardly-inclined bottom wall. The inclination of the bottom wall may vary from a steeper rearward portion to a shallower forward portion.

The supply duct extension suitably narrows by virtue of a downwardly- and forwardly-inclined upper baffle. Again, the inclination of the upper baffle may vary from a steeper rearward portion to a shallower forward portion.

Advantageously, the supply duct extension and the return duct extension have opposed complementary tapers. Elegantly, the tapers of the supply duct extension and the return duct extension may be effected by a common partition serving as a bottom wall for the return duct extension and as an upper baffle for the supply duct extension.

The return inlet may extend rearwardly to a lesser extent than the discharge outlet.

A shelf front strip that is insulated, heated, and/or of low thermal conductivity may be disposed forwardly of the return inlet. The return inlet may be partially defined by that shelf front strip. The shelf front strip may comprise an information display and may extend above a top panel of the shelf to serve as a riser modifying air flow into the return inlet.

The shelf front strip is suitably movable or removable to access the return duct extension.

The return inlet may be centrally disposed over the discharge outlet and a shelf front strip may be inclined rearwardly to face upwardly. A grille may be disposed over the return inlet, and may be movable or removable to access the return duct extension. Such a grille may extend above the top panel, and may comprise an upper section with perforations or other openings to admit air to the return inlet and a solid lower forward section. The lower forward section of the grille is advantageously insulated, heated, and/or of low thermal conductivity.

The return inlet may be substantially level with a top panel of the shelf. Similarly, the discharge outlet may be substantially level with a bottom panel of the shelf. A discharge straightener may, however, extend below the bottom panel from the discharge outlet.

A load-line formation suitably extends above a top panel of the shelf, rearwardly of the return inlet.

A top panel of the shelf suitably partially defines the return duct and a bottom panel of the shelf suitably partially defines the supply duct.

A partition between the return duct and the supply duct may extend into a common dividing wall serving as a bottom wall for the return duct extension and as an upper baffle for the supply duct extension.

Advantageously, the return duct and the supply duct taper forwardly in front-to-back section through the shelf. For example, top and bottom panels of the shelf may converge forwardly to impart the forward taper to the return duct and the supply duct.

One or more duct splitters may be provided in the forward supply duct extension and/or in the forward return duct extension, the or each duct splitter being arranged to increase air flow velocity through a rear portion of the discharge outlet and/or the return inlet. Additionally, the or each duct splitter extends rearwardly into the supply duct and/or the return duct.

The shelf of the invention is preferably arranged to direct spillages or airborne particles entering the return inlet toward a forward collection trough.

One or more forwardly- and downwardly-inclined vanes may be positioned under a rear portion of the return inlet.

The inventive concept also embraces a ducted shelf for an open-fronted display unit employing air curtains, the shelf having: a front and a back defining a forward direction from back to front; a supply duct at a lower level of the shelf communicating with a downwardly-facing forward discharge outlet; and a return duct at an upper level of the shelf communicating with an upwardly-facing forward return inlet; wherein the return inlet is offset forwardly with respect to the discharge outlet.

At least a majority of the return inlet may be disposed forward of a forward edge of the discharge outlet.

Advantageously, the shelf presents a front edge whose thickness from top to bottom is less then the combined thickness of the supply duct and the return duct.

The supply duct may taper or terminate rearwardly of the front edge.

In front-to-back section through the shelf, the shelf suitably has a stepped forward profile comprising an upper forward step at the upper level of the shelf and a lower rearward step at the lower level of the shelf, the front edge of the shelf being defined by the upper forward step.

The invention extends to an open-fronted display unit comprising at least one ducted shelf of the invention.

In order that the invention may be more readily understood, reference will now be made by way of example to the accompanying drawings, in which.

Figure 4:
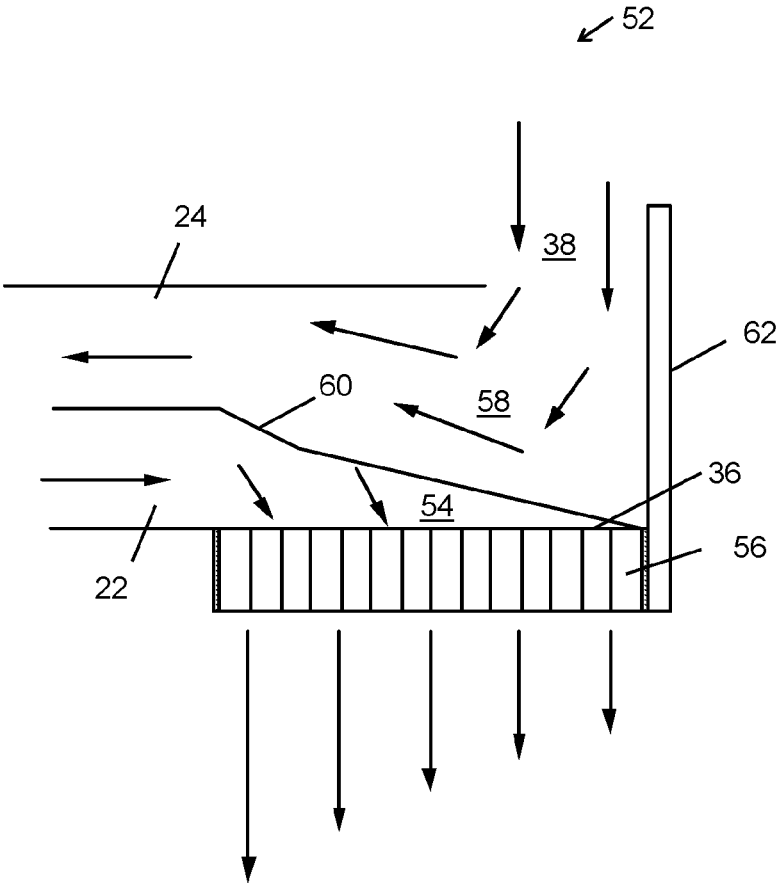
FIG. 4 is an enlarged cross-sectional detail view of the front of a ducted shelf shown in the appliance of FIG. 3, the shelf comprising discharge and return air grilles that discharge and receive air curtains projected across the front of product display spaces of the appliance.
Figure 5A:
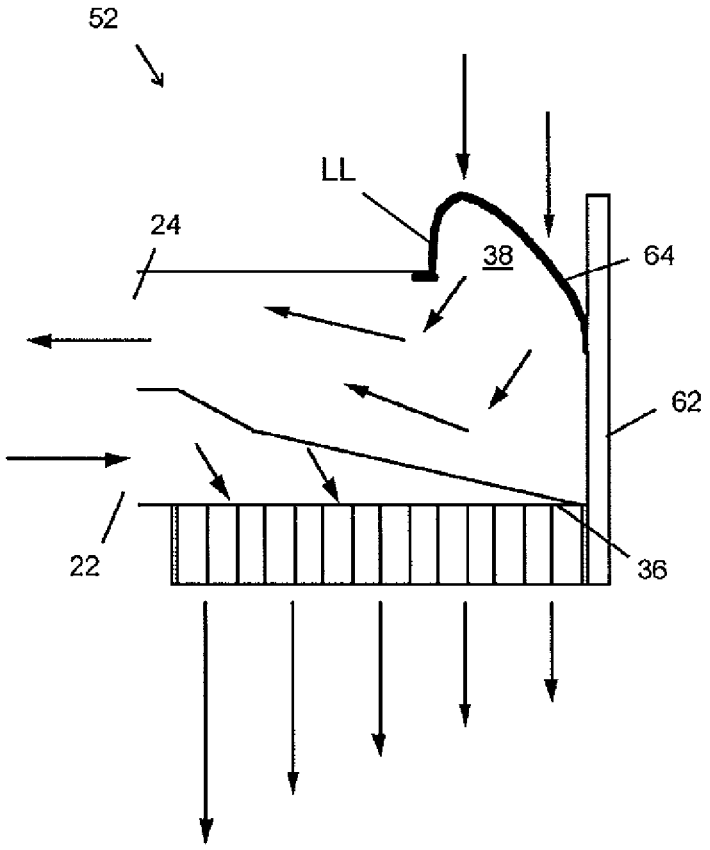
Figure 5B:
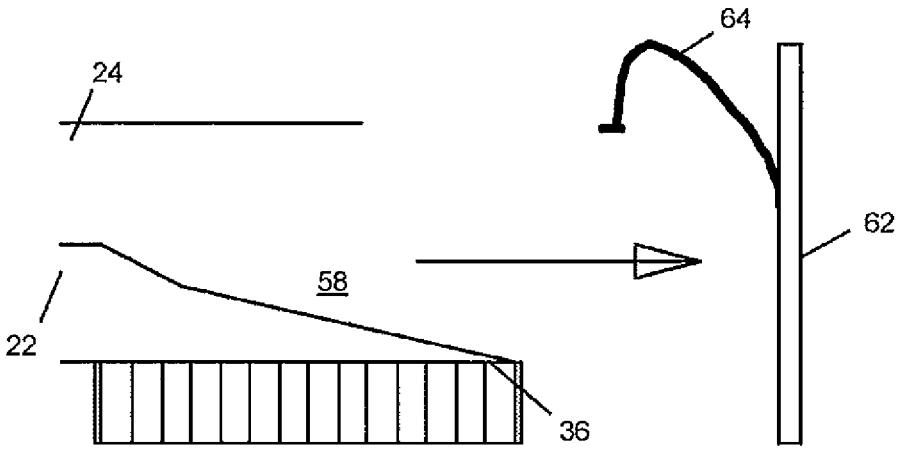
Figure 6:
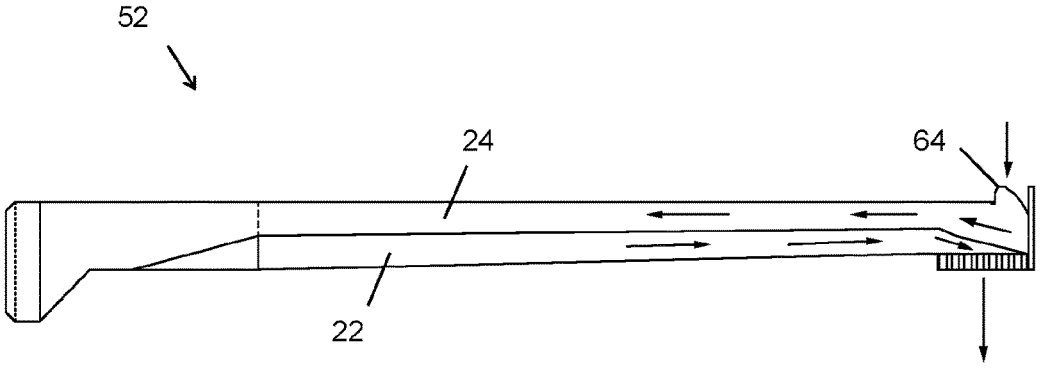

FIGS. 5*a* and 5*b* are enlarged cross-sectional detail views showing a variant of the discharge and return arrangement shown in FIG. 4;

FIG. 6 is a cross-sectional view from front to back through a ducted shelf of the invention, including the discharge and return arrangement shown in FIGS. 5*a* and 5*b;*

Figure 7:
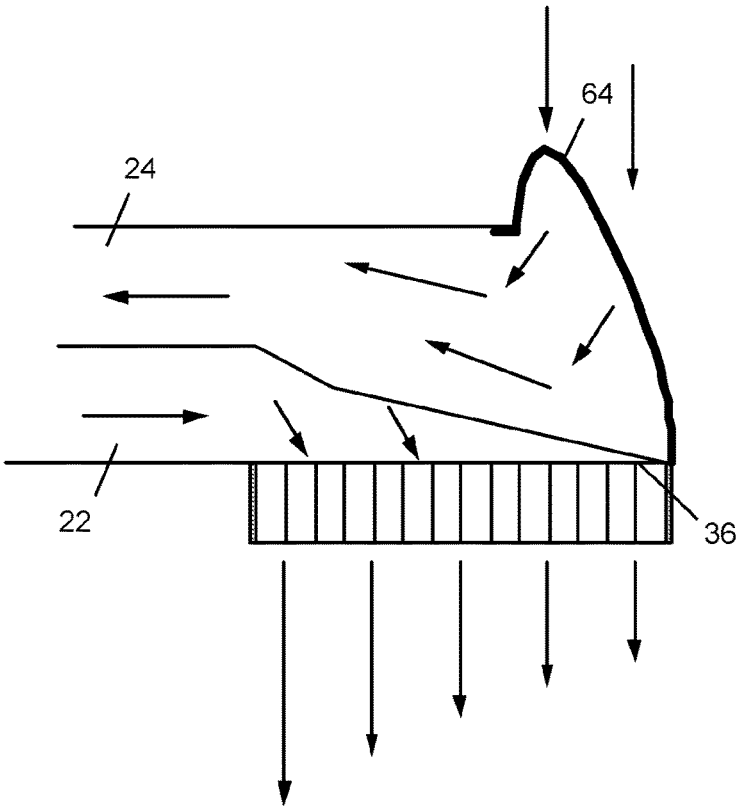

FIG. 7 is an enlarged cross-sectional detail view showing a further variant of the discharge and return arrangement shown in FIGS. 5*a* and 5*b;*

Figure 8:
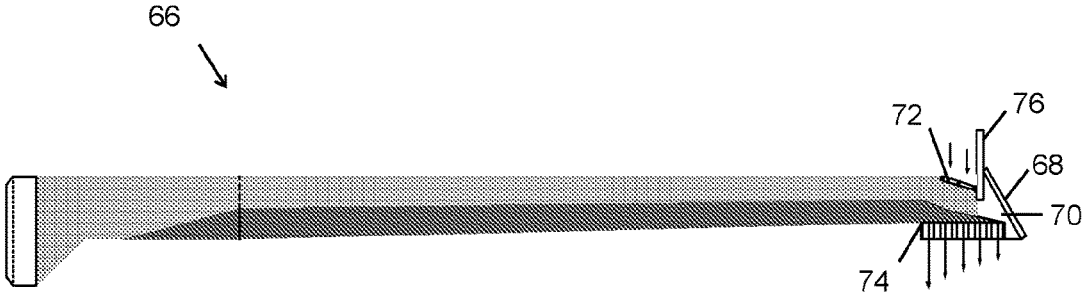
Figure 9:
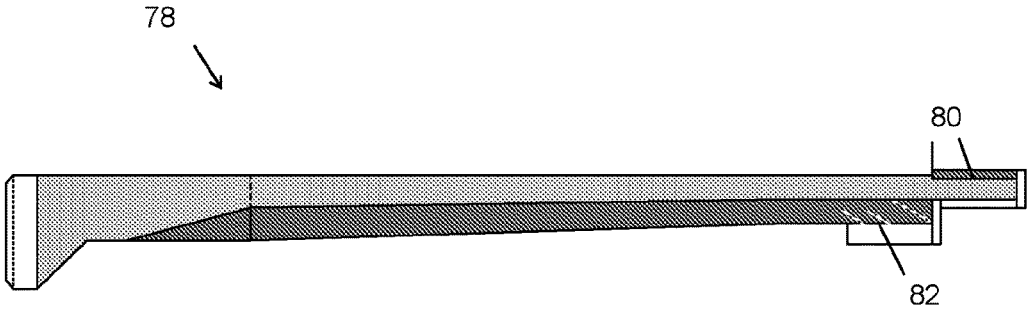

FIGS. 8 and 9 are cross-sectional views from front to back through a ducted shelf of the invention including other discharge and return arrangements; and FIGS. 10 to 14 are enlarged cross-sectional detail views showing further variants of the discharge and return arrangement.

Figure 1:
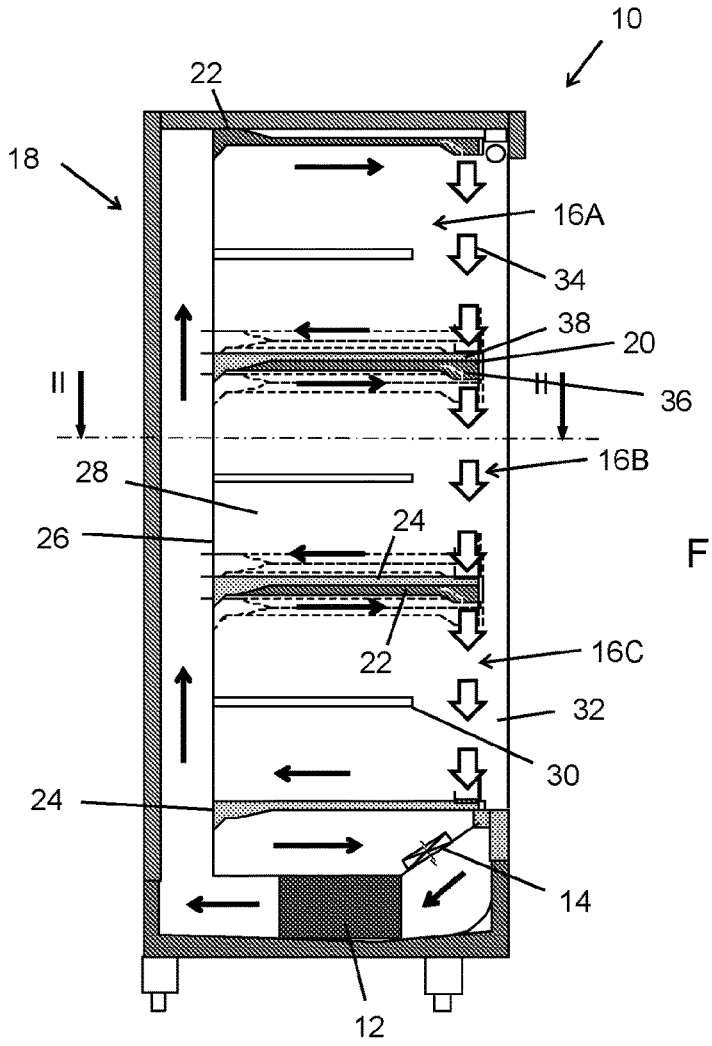
FIG. 1 is a sectional side view of a refrigerated display appliance, taken on line I-I of FIG. 2.

Referring firstly to FIG. 1, this shows a refrigerated integrated multi-cellular display appliance 10. The appliance 10 has a bottom-mounted evaporator 12 fed with air by supply fans 14, although other arrangements are possible for the production and circulation of cold air. Here, cold air from the evaporator 12 is supplied to a plurality of airflow-managed cells 16A, 16B, 16C that are stacked in a vertical array or column and are all disposed within a single insulated cabinet 18. In this example, there are three cells in the stack, namely a top cell 16A, an inner cell 16B and a bottom cell 16C.

The cells 16A, 16B, 16C are separated here by two ducted shelves 20 constructed in accordance with the invention. The cells 16A, 16B, 16C can be of different heights and may be arranged to store items at different temperatures to reflect storage requirements for various items. The shelves 20 could be fixed but are height-adjustable in this example, as shown by the dashed lines in FIG. 1, so that the relative heights of the cells 16A, 16B, 16C can be adapted to suit different retail requirements.

The ducted shelves 20 each comprise a sandwich of a supply duct 22 and a return duct 24. The shelves 20 subdivide the internal volume of the cabinet 16 into a plurality of product display spaces stacked one atop another, each in its own airflow-managed cell 16A, 16B, 16C. Each shelf 20 defines the top wall of a lower cell in the stack and the bottom wall of an adjacent upper cell in the stack.

The top wall of the top cell 16A is defined by an additional supply duct 22 above a top inner panel of the cabinet 18. Similarly, the bottom wall of the bottom cell 16C is defined by an additional return duct 24 beneath a bottom inner panel of the cabinet 18 that also serves as an additional shelf for the display of refrigerated items. Advantageously, the additional supply duct 22 and the additional return duct 24 may be identical to those used in the shelves 20.

At their back and side edges, the ducted shelves 20 lie closely against the back inner panel 26 and the side walls 28 of the cabinet 18, to discourage airflow around those edges of the shelves 20. Seals may be provided along those edges of the shelves 20 if required.

FIG. 1 also shows optional non-ducted intermediate shelves 30, one at an intermediate level in each cell 14 and set back from the front of the ducted shelves 20, to facilitate display of different types of food products and to make best use of the available space. One or more of the intermediate shelves 30 may be perforated or slotted to improve air movement in the cells 16A, 16B, 16C. The intermediate shelves 30 need not seal against the back inner panel 26 or the side walls 28 of the cabinet 18.

Each cell 16A, 16B, 16C is generally in the form of a hollow cuboid or box enclosing a correspondingly-shaped product display space. Front access openings 32 give unhindered reach-in access to any items in the product display spaces defined by the cells 16A, 16B, 160.

In use, each access opening 32 is sealed by a generally-vertical air curtain 34 that flows downwardly in front of the associated cell 16A, 16B, 16C. The air curtain 34 extends between a downwardly-facing discharge air grille (DAG) or discharge terminal 36 and an upwardly-facing return air grille (RAG) or return terminal 38. Cooled air is supplied through a supply duct 22 to the DAG 36, which projects the air curtain 34, and is returned through a return duct 24 via the RAG 38, which receives air from the air curtain 34. The air received from the air curtain 28 will inevitably include some entrained ambient air, from which heat and moisture must be removed during recirculation within the appliance 10, although the arrangement illustrated will greatly reduce the rate of entrainment in comparison with standard designs.

Figure 2:
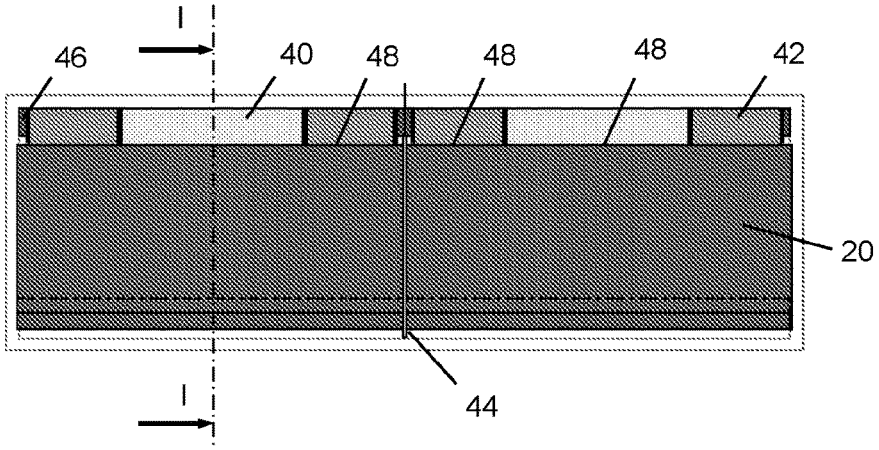
FIG. 2 is a sectional top view of the appliance of FIG. 1, taken on line II-II of FIG. 1.

With reference now also to FIG. 2 of the drawings, the supply ducts 22 and the return ducts 24 that communicate at the front with the DAGs 36 and RAGs 38 respectively communicate at the rear with respective riser ducts 40, 42, namely a supply riser duct 40 and a return riser duct 42. The riser ducts 40, 42 extend upwardly between the back inner panel 26 and the adjacent insulated rear wall of the cabinet 18.

In the example shown in FIG. 2, one supply riser duct 40 is disposed between two return riser ducts 42. FIG. 2 also shows ducted shelves 20 and riser ducts 40, 42 of two columns of cells 16 disposed side-by-side in the common insulated cabinet 18, divided here by a vertical partition 44 that is suitably of transparent material, such as perspex or tempered glass, for ease of viewing.

At its rear edge, the partition 44 lies closely against, and is preferably sealed to, the back inner panel 26. The partition 44 extends from the back inner panel 26 substantially the full depth of the shelves 20 from front to rear. Preferably, as shown, the partition 44 extends slightly forward of the front edges of the shelves 20. The partition 44 prevent air flows from spilling from one column to the next and possibly disrupting the air curtain dynamics of adjacent cells.

The front edge regions of the partition 44 and the shelves 20 may be insulated and/or heated to fight condensation. It is also possible for the front edge regions of the partition 44 and the shelves 20 to be of a low-conductivity material and/or to have a high-emissivity finish.

If shelves 20 of neighbouring columns are aligned, the partition 44 may be removed to increase the effective display area.

Another feature shown in FIG. 2 is that each column has pair of keybars 46 that extend vertically on the outer sides of the return riser ducts 42. The keybars 46 support the weight of the shelves 20 and provide a vertical array of slots into which spigots at the back of a shelf 20 can locate at any suitable height.

In use of the appliance 10, cold air is ducted from the evaporator 12 to each cell 16A, 16B, 16C and warmer return air is returned from each cell 16A, 16B, 16C to the coil 12 for cooling, drying, optional filtering and recirculation.

Air is blown through the evaporator 12 by the fans 14 and then propelled up the central supply riser duct 40. From there, the air enters the supply ducts 22 in the ducted shelves 20 and at the top of the cabinet 18 to be projected as a stack of air curtains 34 through the DAGs 36, one per cell 16A, 16B, 16C. The return air from the air curtains 34 is returned via the RAGs 38 and the return ducts 24 in the shelves 20 and at the bottom of the cabinet 18, to enter the return riser ducts 42 on each side of the central supply riser duct 40. The return air flows downwardly in those return riser ducts 42 under the suction of the fans 14 to enter the evaporator 12 again.

The requirement for airflow to the ducted shelves 20 requires ports 48 in the back inner panel 26 leading to the supply riser duct 40 and the return riser ducts 42. Various port arrangements are disclosed in WO 2011/121285 and so need no further elaboration here. For now, it is sufficient to note that those ports 48 are spaced in vertical arrays aligned with the parallel vertically-extending supply riser duct 40 and the return riser ducts 42, to allow for the shelves 20 to be removed and optionally relocated at different heights. Advantageously, those ports 48 are open only when a shelf 20 is coupled with them to reduce unwanted spillage of cold air into the cabinet 18. Again, WO 2011/121285 discloses ways in which the ports 48 could be closed off when not in use; other arrangements are described in parallel patent applications filed by the Applicant.

Figure 3:
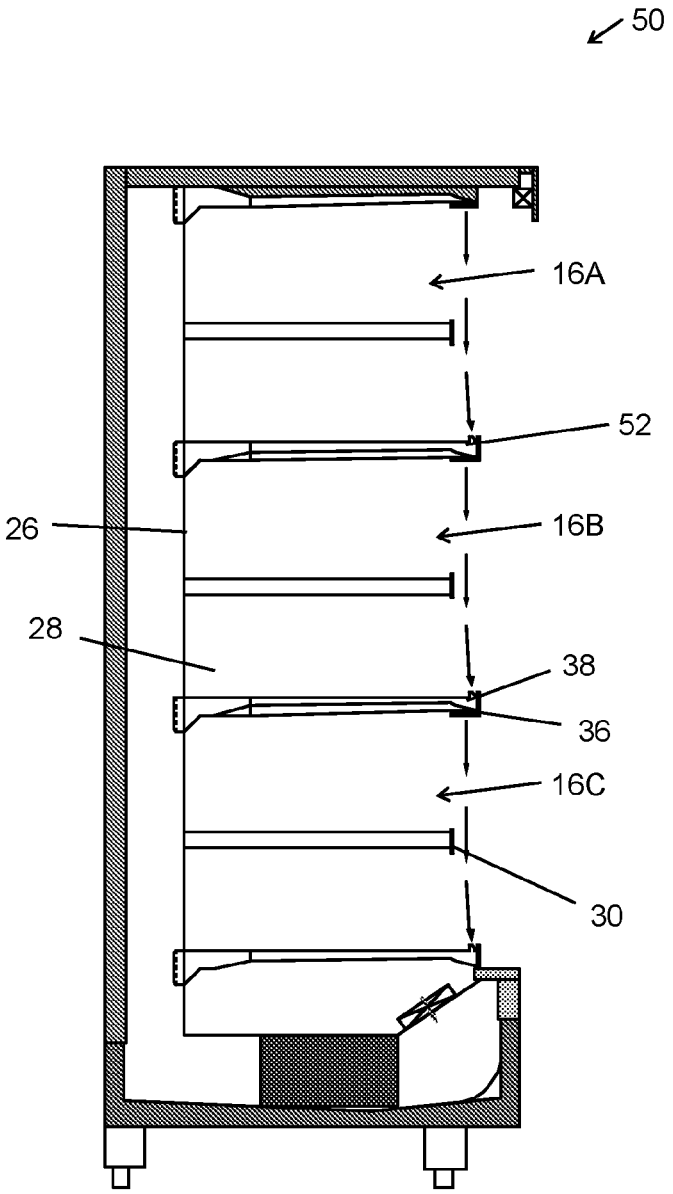
FIG. 3 is a sectional side view corresponding to FIG. 1 but showing a refrigerated display appliance in accordance with the invention.

FIG. 3 shows an appliance 50 in accordance with the invention. The appliance 50 is similar to the appliance 10 shown in FIGS. 1 and 2, and like numerals are used for like parts. The principal difference is that the relatively bulky ducted shelves 20 have been replaced with slimmer ducted shelves 52 made possible by the invention. This improves visibility of, and access to, products displayed in the cells 16A, 16B, 16C.

Features of the slimmer shelves 52, particularly a DAG 36 and RAG 38 of reduced front to back depth, aids alignment of shelf fronts with the non-ducted intermediate shelves 30 in the cells 16A, 16B, 16C. This enables the intermediate shelves 30 to be made deeper from front to back, hence extending forwardly to a greater extent than the intermediate shelves 30 shown in FIG. 1. This improves control of the air flow within and across the front of the cells 16A, 16B, 16C, increases display area and improves visibility of, and access to, products placed on the intermediate shelves 30.

Turning now to FIG. 4, this shows discharge and return arrangements at the front of a ducted shelf 52 in accordance with the invention. A supply duct 22 at a lower level of the shelf 52 communicates with a downwardly-facing DAG 36 via a forwardly-tapering forward discharge extension 54 that narrows above the DAG 36. An optional slim-line honeycomb 56 or other airflow-balancing means such as a linear-slotted diffuser is placed across the DAG 36.

A return duct 24 at an upper level of the shelf 52 communicates with an upwardly-facing RAG 38 via a rearwardly-tapering forward return extension 58. The forward return extension 58 reaches downwardly to the lower level of the shelf 52, effectively to lie forwardly of the supply duct 22.

An inclined partition 60 serves as the bottom wall of the forward return extension 58 and as the top wall of the forward discharge extension 54. The inclination of the partition 60 varies from a steeper rearward portion to a shallower forward portion.

An upright shelf finisher 62 is attached to the front of the shelf 52 at the forward end of the forward discharge extension 54. The shelf finisher 62 is insulated, heated and/or of material of low thermal conductivity to combat condensation at the front of the shelf 50 in use.

The shelf finisher 62 extends upwardly to a level beyond the top of the return duct 24. In this example, the shelf finisher 62 defines one side of the RAG 38 or acts as a riser to contain cold air in front of the RAG 38.

The shelf finisher 62 could comprise a standard or modified ticket strip employed to display price, information and promotions. Thus, the shelf finisher 62 is also suitable to bear sales information ticketing and whilst it may be larger if desired, it need be no deeper than the width of a sales information ticket strip, which is typically 45 mm to 50 mm.

The contraction of the supply duct 22 by virtue of the tapering forward discharge extension 54 advantageously biases higher-velocity air to the rear of the DAG 36 to profile the air curtain velocity accordingly. The same contraction, in the reverse direction through the forward return extension 58, is also useful to guide airflow from the RAG 38 to the return duct 24. Also, this arrangement helpfully contains spills from the shelf 52 to the bottom of the forward return extension 58 before any liquid can enter the return air duct 24.

FIGS. 5*a* and 5*b* show how a RAG variant 64 may be shaped to project above the level of the return duct 24 so as to act as a load-line LL for objects placed on the shelf 52 and hence to avoid disruption to the air curtain. The arched shape of the RAG 64 in this example also discourages objects being placed on top of the RAG 64 and so blocking airflow into the return duct 24. Also, FIG. 5*b* shows how the shelf finisher 64 may be 10 removed easily to enable cleaning of spills trapped in the forward return extension 58. Conveniently, the RAG 38 may be attached to and hence removable with the shelf finisher 62 as shown.

FIG. 6 shows a full shelf 52 fitted with the RAG 64 in side view. This view shows tapering of the shelf thickness approaching the front, to the benefit of visibility and access. This tapering also reflects back-to-front tapering of the supply duct 22 and front-to-back expansion of the return duct 24, both of which are advantageous for air flow in those ducts.

In the variant shown in FIG. 7, the shelf finisher 62 is removed and so the RAG 64 forms the shelf front. In this instance, the bottom section of the RAG 64 need not be perforated and may be insulated, heated and/or of material of low thermal conductivity to prevent condensation.

FIG. 8 shows a full shelf 66 with a sloping front finisher 68 backed by insulation 70. The finisher 68 in this example leans back at the top for ease of viewing any sales information carried by the finisher 68. In comparison with the preceding embodiments, the RAG 72 is pushed back to make space for the sloping finisher 68 and is disposed substantially centrally over the DAG 74. In this example, the RAG 72 is inclined to face forwardly and upwardly and is positioned behind an optional riser 76 that extends above both the RAG 72 and the finisher 68 to contain cold air in front of the RAG 72.

Turning next to FIG. 9, this shows another shelf 78 within the inventive concept that also solves the problem of visibility and access. In this arrangement, the problem is solved by an offset shelf front in which the RAG 80 is set forwardly of the DAG 82. This reduces the visual effect and apparent thickness of the shelf front when viewed from an eye-line that is typically above the level of the shelf 78. Even if the shelf front is no thinner when viewed from the same level as the shelf 78, there is an improved viewing angle into a lower product display space below the shelf 78 when viewed from a typically elevated eye-line.

Figure 10:
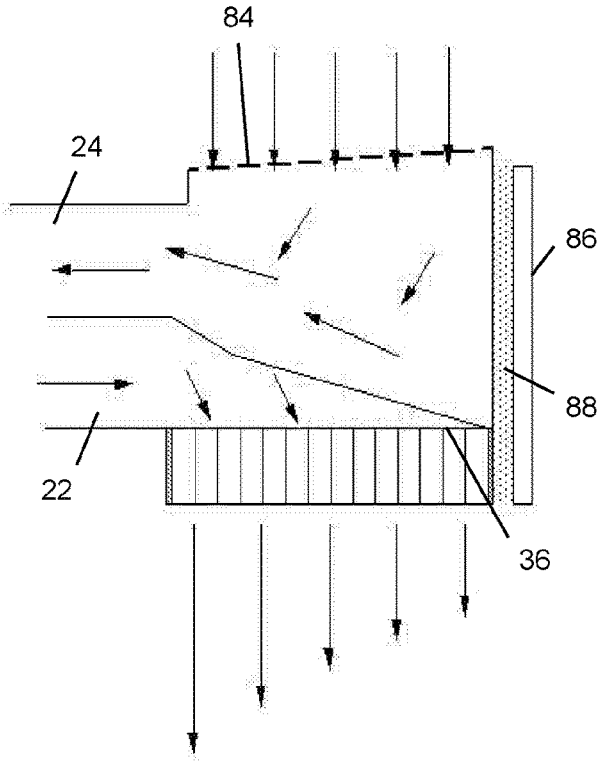

FIG. 10 shows an alternative slotted or otherwise perforated RAG 84 that is inclined to face upwardly and rearwardly and may be hinged and/or removable for cleaning. An upright front finisher 86 backed by insulation 88 may bear a ticket strip to display prices and promotions. The ticket strip may be integrated with the finisher 86. Again, the finisher 86 may also, or alternatively, be of a material of low thermal conductivity and/or be heated as necessary to prevent condensation.

Figure 11:
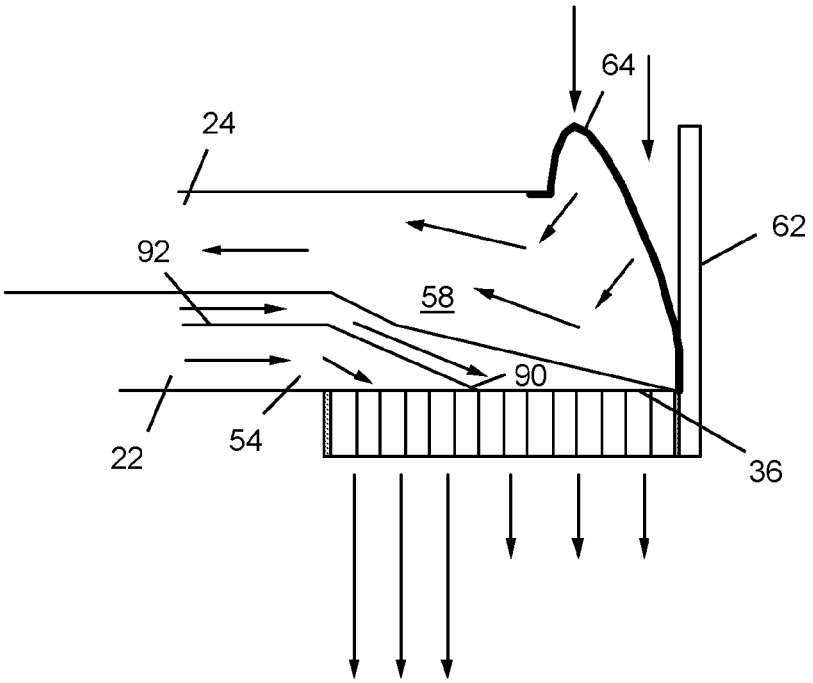
Figure 12:
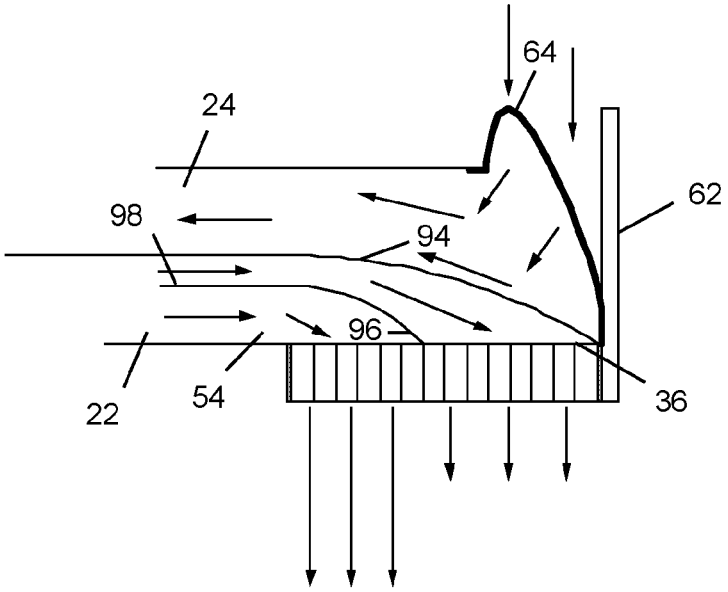

Turning next to FIGS. 11 and 12 of the drawings, these show the possibility of creating separate supply air channels to achieve advantageously higher velocities on the rear face of the air curtain than on the front face of the air curtain. This minimises entrainment of ambient air.

For example, the variant shown in FIG. 11 broadly corresponds to that shown in FIGS. 5*a* and 5*b*; like numerals are used for like parts. This arrangement therefore maintains the possibility of spill collection and cleaning by removing the finisher 62 and/or the RAG 64. In this instance, however, an inclined duct splitter 90 divides the forward discharge extension 54 with an inclination similar to, but slightly more upright than, the partition 60 between the forward discharge extension 54 and the forward return extension 58. The duct splitter 90 extends down substantially to the level of the DAG 36 in this example. Separation of the supply air in this way may be tailored to favour directing more air to the rear or inner side of the DAG 36.

Optionally, the duct splitter 90 shown in FIG. 11 includes a generally-horizontal rearward extension 92 that extends rearwardly into the supply duct 22 as shown. The duct splitter 90 can be positioned and extended as far back along the supply duct 22 as may be necessary to achieve the desired air flow proportions on each side of the duct splitter 90.

The variant shown in FIG. 12 again broadly corresponds to that shown in FIGS. 5*a* and 5*b*, so again like numerals are used for like parts. In this example, the partition 94 between the forward discharge extension 54 and the forward return extension 58 is smoothly curved down to the forward extremity of the forward discharge extension 54, with concave curvature when viewed from underneath. The duct splitter 96 is similarly curved and extends down substantially to the level of the DAG 36 but again has a generally-horizontal rearward extension 98 that extends rearwardly into the supply duct 22.

Figure 13:
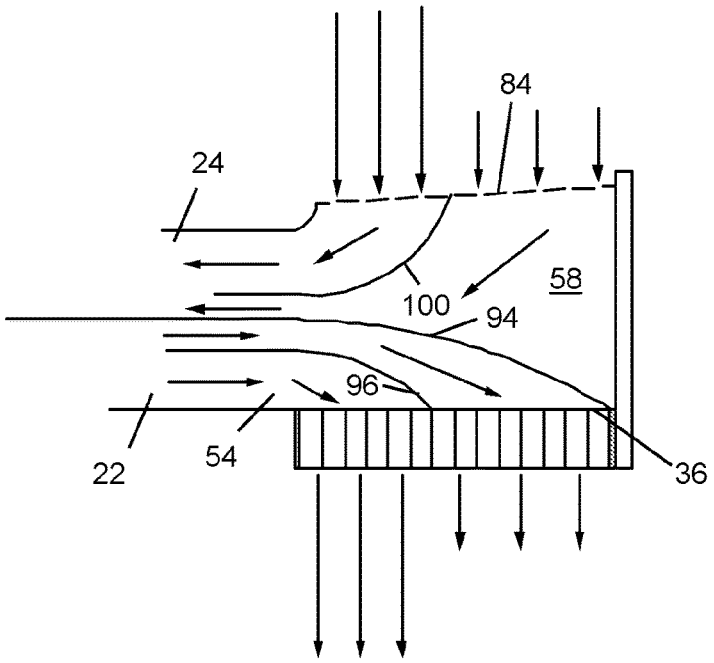

FIG. 13, like FIG. 10, shows a slotted or otherwise perforated RAG 84 that is inclined to face upwardly and rearwardly and may be hinged and/or removable for cleaning. Also, like FIG. 12, a curved partition 94 is disposed between the forward discharge extension 54 and the forward return extension 58 and a similarly-curved splitter 96 is disposed under the partition 94. However, FIG. 13 shows how the forward return extension 58 and optionally also the return duct 24 can also be split with a return duct splitter 100 to enable air flow velocity to the rear of the air curtain to be increased so as to minimise entrainment of ambient air. However a disadvantage with this arrangement is that spills entering the higher-velocity rear section of the RAG 84 will not be channeled towards a collection point outside the return duct 24.

Figure 14:
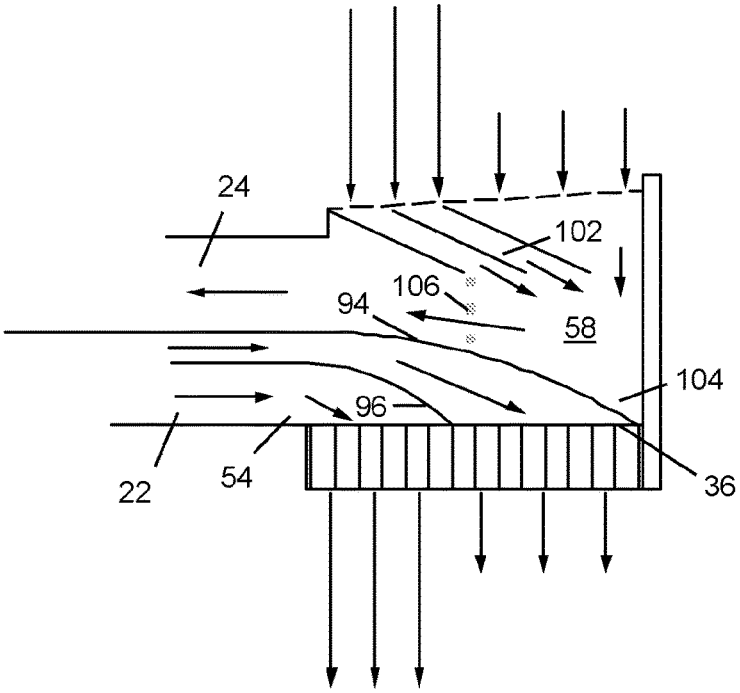

To address this concern, the arrangement shown in FIG. 14 broadly corresponds to that shown in FIG. 13 and like numerals are used for like parts. In this instance, a horizontal array of forwardly- and downwardly-inclined guide vanes 102 positioned under the RAG 84 to receive higher-velocity air to the rear of the RAG 84 performs three functions, namely:

- to divert any spills from the rear portion of the RAG 84 towards the lower forward collection trough 104;
- to direct airborne particles such as dust and lint towards the collection trough 104, noting that the momentum and direction imparted by the vanes 102 to such particles will help to separate them from the airstream in a similar way to a dust cyclone; and
- to bias the airflow of the incoming air curtain towards the rear part of RAG 84. In this regard, the vanes 102 act in a similar way to the previously-described duct splitters to reduce the air flow to the forward part of the RAG 84, again reducing entrainment of ambient air.

FIG. 14 shows spilled liquids 106 dripping from the vanes 102 onto the partition 94 between the forward discharge extension 54 and the forward return extension 58, from where the liquids will drain away from the return duct 24 and into the collection trough 104. FIG. 14 also shows dirt trapped in the collection trough 104 by virtue of the vanes 102. The RAG 84 and/or the front of the shelf should be easily movable or removable for easy regular cleaning of the collection trough.

Many variations are possible within the inventive concept. For instance, in other examples having more than three cells in the stack, there will be more than one inner cell and more than two ducted shelves; □conversely where there are only two cells in the stack, there will be no inner cell and only one ducted shelf. □

One or both of the side walls of the cabinet could be transparent to enhance visibility of the items displayed in the product display spaces, in which case the side walls are suitably of tempered glass and double- or triple-glazed to maintain a degree of insulation.

The appliance need not have an internal refrigerator engine if cold air is produced elsewhere, for example in a remote fan coil unit, and pumped to the appliance. Thus, the refrigerator engine can be included in the cabinet as an integral unit or cooling can be supplied remotely from a typical supermarket refrigeration pack unit. Local cooling necessitates a drainage system for condensate water.

To deal with any condensation that may form in a ducted shelf, such shelves may be provided with drains to collect moisture and to drain it away. For example, a return duct in a ducted shelf could be inclined downwardly and rearwardly to fall toward the rear of the cabinet, where it may lead water to a drainage system provided for the evaporator to reject water from the cabinet.

If used in the appliance, cooling coils and fans may be located behind the cells but could instead be situated to the top, bottom or sides of the cells.

What is claimed is:

1. A ducted shelf for an open-fronted display unit employing air curtains, the shelf having:

a front and a back defining a forward direction from back to front;

a supply duct at a lower level of the shelf communicating with a downwardly-facing forward discharge outlet; and a return duct at an upper level of the shelf communicating with an upwardly-facing forward return inlet;

wherein, in a front-to-back section through the shelf, a forward supply duct extension in front of the supply duct narrows forwardly above the discharge outlet and a forward return duct extension in front of the return duct reaches downwardly to the lower level of the shelf to lie forwardly of the supply duct.

2. The shelf of claim 1, wherein the return duct extension widens forwardly below the return inlet.

3. The shelf of claim 1, wherein the return duct extension narrows rearwardly beyond a rearward edge of the return inlet.

4. The shelf of claim 1, wherein the return duct extension widens forwardly and narrows rearwardly by virtue of a downwardly- and forwardly-inclined bottom wall.

5. The shelf of claim 4, wherein the inclination of the bottom wall varies from a steeper rearward portion to a shallower forward portion.

6. The shelf of claim 1, wherein the supply duct extension narrows by virtue of a downwardly- and forwardly-inclined upper baffle.

7. The shelf of claim 6, wherein the inclination of the upper baffle varies from a steeper rearward portion to a shallower forward portion.

8. The shelf of claim 1, wherein the supply duct extension and the return duct extension have opposed complementary tapers.

9. The shelf of claim 8, wherein the tapers of the supply duct extension and the return duct extension are effected by a common partition serving as a bottom wall for the return duct extension and as an upper baffle for the supply duct extension.

10. The shelf of claim 1, wherein the return inlet extends rearwardly to a lesser extent than the discharge outlet.

11. The shelf of claim 1, wherein a shelf front strip that is at least one of insulated, heated, or of low thermal conductivity is disposed forwardly of the return inlet.

12. The shelf of claim 11, wherein the return inlet is partially defined by the shelf front strip.

13. The shelf of claim 11, wherein the shelf front strip comprises an information display.

14. The shelf of claim 11, wherein the shelf front strip extends above a top panel of the shelf to serve as a riser modifying air flow into the return inlet.

15. The shelf of claim 11, wherein the shelf front strip is movable or removable to access the return duct extension.

16. The shelf of claim 1, wherein the return inlet is centrally disposed over the discharge outlet and a shelf front strip is inclined rearwardly to face upwardly.

17. The shelf of claim 1, wherein a grille is disposed over the return inlet.

18. The shelf of claim 17, wherein the grille is movable or removable to access the return duct extension.

19. The shelf of claim 17, wherein the grille extends above a top panel.

20. The shelf of claim 17, wherein the grille comprises an upper section with perforations or other openings to admit air to the return inlet and a solid lower forward section.

21. The shelf of claim 17, wherein a lower forward section of the grille is at least one of insulated, heated, or of low thermal conductivity.

22. The shelf of claim 1, wherein the return inlet is substantially level with a top panel of the shelf.

23. The shelf of claim 1, wherein a load-line formation extends above a top panel of the shelf, rearwardly of the return inlet.

24. The shelf of claim 1, wherein the discharge outlet is substantially level with a bottom panel of the shelf.

25. The shelf of claim 24, wherein a discharge straightener extends below the bottom panel from the discharge outlet.

26. The shelf of claim 1, wherein a top panel of the shelf partially defines the return duct and a bottom panel of the shelf partially defines the supply duct.

27. The shelf of claim 1, wherein a partition between the return duct and the supply duct extends into a common dividing wall serving as a bottom wall for the return duct extension and as an upper baffle for the supply duct extension.

28. The shelf of claim 1, wherein in front-to-back section through the shelf, the return duct and the supply duct taper forwardly.

29. The shelf of claim 28, wherein top and bottom panels of the shelf converge forwardly to impart the forward taper to the return duct and the supply duct.

30. The shelf of claim 1 further comprising one or more duct splitters in at least one of the forward supply duct extension or the forward return duct extension, the one or more duct splitters arranged to increase air flow velocity through a rear portion of at least one of the discharge outlet or the return inlet.

31. The shelf of claim 30, wherein the one or more duct splitters extend rearwardly into at least one of the supply duct or the return duct.

32. The shelf of claim 1, the shelf being arranged to direct spillages or airborne particles entering the return inlet toward a forward collection trough.

33. The shelf of claim 1 and comprising one or more forwardly- and downwardly-inclined vanes positioned under a rear portion of the return inlet.

34. An open-fronted display unit employing air curtains and comprising:

at least one shelf having:

a front and a back defining a forward direction from back to front;

a supply duct at a lower level of the shelf communicating with a downwardly-facing forward discharge outlet; and a return duct at an upper level of the shelf communicating with an upwardly-facing forward return inlet;

wherein, in a front-to-back section through the shelf, a forward supply duct extension in front of the supply duct narrows forwardly above the discharge outlet and a forward return duct extension in front of the return duct reaches downwardly to the lower level of the shelf to lie forwardly of the supply duct.

* * * * *